United States Patent [19]

Wood et al.

[11] 4,367,783

[45] Jan. 11, 1983

[54] METHOD AND APPARATUS FOR CONTINUOUS CASTING OF METAL UNDER CONTROLLED LOAD CONDITIONS

[75] Inventors: John F. B. Wood, Burlington; Stanley W. Platek, Essex Junction; Joseph C. O'Kane; Gary P. Ackel, both of Burlington, all of Vt.

[73] Assignee: Hazelett Strip-Casting Corporation, Winooski, Vt.

[21] Appl. No.: 201,006

[22] Filed: Oct. 27, 1980

[51] Int. Cl.³ ..... B22D 11/06; B22D 11/16

[52] U.S. Cl. ..... 164/452; 164/455; 164/154; 164/481; 164/432; 164/485; 164/443

[58] Field of Search ..... 164/451–455, 164/481, 482, 154, 155, 449, 450, 431, 432, 485, 443

[56] References Cited

U.S. PATENT DOCUMENTS

| | | | |
|---|---|---|---|
| 2,640,235 | 6/1953 | Hazelett | 164/481 |
| 2,904,860 | 9/1959 | Hazelett | 164/481 |
| 3,036,348 | 5/1962 | Hazelett et al. | 164/432 |
| 3,041,686 | 7/1962 | Hazelett et al. | 164/481 |
| 3,167,830 | 2/1965 | Hazelett et al. | 164/431 |
| 3,310,849 | 3/1967 | Hazelett et al. | 164/432 |
| 3,828,841 | 8/1974 | Hazelett et al. | 164/432 |
| 3,848,658 | 11/1974 | Hazelett et al. | 164/432 |
| 3,864,973 | 2/1975 | Petry | 164/432 X |
| 3,865,176 | 2/1975 | Dompas et al. | 164/481 |
| 3,878,883 | 4/1975 | Hazelett et al. | 164/432 |
| 3,937,270 | 2/1976 | Hazelett et al. | 164/481 |
| 4,062,235 | 12/1977 | Hazelett et al. | 73/159 |
| 4,150,711 | 4/1979 | Hazelett et al. | 164/481 |

*Primary Examiner*—Gus T. Hampilos
*Assistant Examiner*—K. Y. Lin
*Attorney, Agent, or Firm*—Parmelee, Bollinger & Bramblett

[57] ABSTRACT

An improvement in continuous metal casting machines of the type having a pair of flexible, moving casting belts which revolve along endless paths for defining a casting region therebetween and moving side dams which revolve along with the casting belts for confining the cast strip, slab or bar laterally. The casting belts are individually supported by upper and lower carriage means. The machine is provided with sensors such as load cells for sensing the displacement forces existing between the upper and lower carriages at selected points along the path of belt travel, and for sensing the side pressures exerted upon the side dams by the cooling, solidifying metal. This sensing permits the maintenance of predetermined, desired contact pressures along the length of the solidifying metal to thereby improve the physical characteristics of the cast product. The sensor outputs may be utilized to manually adjust the pressure points or, alternatively, may be employed in an automatic feedback system for providing automatic control of the various casting parameters affecting mold contact pressures and pressure distribution.

25 Claims, 8 Drawing Figures

9
LC
75
10
16
14
17
97
99

LC
9A
75
24
49
10
36
54
88
110
104
20
86
WATER OUT
76
22
78
50
26
28
WATER IN
14
17
97
99
66

10
20
22
23
26
28
36
50
58
64
76
77
78
80
82
84
86
88
99
104

9A
UC
LC
75
49
24
83
81
14
74
72
70
27
25
36
11
15
54
10
79
77
85
91
93
87
89
68
110
X
Y

METHOD AND APPARATUS FOR CONTINUOUS CASTING OF METAL UNDER CONTROLLED LOAD CONDITIONS

BACKGROUND OF THE INVENTION

This invention relates to machines and processes for casting metal strips, slabs or bars directly from molten metal and, more particularly, for continuously casting such metal products between spaced parallel portions of a pair of revolving flexible endless metal belts which are moved along with opposite surfaces of the metal being cast, called twin-belt casting machines or twin-belt casters.

The invention is described as embodied in the structure and operation of a twin-belt continuous casting machine in which the molten metal is fed into a casting region between opposed, parallel portions of a pair of moving, flexible metal belts. The moving belts confine the molten metal between them and carry the metal along as it solidifies into a strip, slab or bar. Spaced rollers having narrow ridges support and guide the belts while holding them accurately positioned and aligned as they move along so as to produce a cast metal product of high quality and having good surface qualities. The vast quantities of heat liberated by the molten metal as it solidifies are withdrawn through the portions of the two belts which are adjacent to the metal being cast. This large amount of heat is withdrawn by cooling the reverse surfaces of the belts by means of rapidly moving, substantially continuous, films of liquid coolant traveling along against these surfaces. The edges of the molten strip are contained between a spaced, parallel pair of side dams in the form of a plurality of blocks strung together on flexible metal straps to form a pair of endless flexible assemblies suitable for containing the molten metal as it solidifies.

Examples of twin-belt casting machines will be found in U.S. Pat. Nos. 2,640,235; 2,904,860; 3,036,348; 3,041,686; 3,167,830; 3,828,841; 3,848,658; 3,878,883; and 3,864,973.

In machines of this type, the moving belts are very thin and are cooled by substantial quantities of liquid coolant, usually water containing corrosion inhibitors. This coolant serves to cool the metal from its molten state as it enters at one end of the machine causing it to solidify as it passes through the machine. As will be understood, solidification of the metal product takes place from outside to inside so that, through most of its passage through the machine, it is in the form of a solidified shell having a molten, constantly decreasing, interior volume. It will also be understood that, as the metal cools and solidifies, it shrinks. The shrinkage is very slight but, nevertheless, is sufficient to cause surface regions of the metal sometimes to pull away from the cooling, moving belts or from the side dams which serve as cooling means for the side surfaces of the product being cast. When this separation between areas of the metal surface and the cooling surface occurs, hot spots and non-uniform cooling are caused, which result in imperfections in the finished casting.

It is an object of the present invention to provide method and apparatus for continuously casting metal strip of high quality directly from molten metal.

Other objects are to provide such method and apparatus wherein the contact pressures between the casting belts and the metal strip and between the side dams and the metal strip are continuously monitored along the length of the strip to maintain and assure desired predetermined contact pressures therealong and to assure desired pressure distribution.

It is among the many advantages of the method and apparatus of the present invention that the mold contact parameters of the casting operation in a twin-belt casting machine are enabled to be more precisely controlled than previously and can be automatically controlled by a feedback system if desired.

SUMMARY OF THE INVENTION

An improvement in the method of continuously casting metal strip, slab or bar directly from molten metal wherein the molten metal is solidified in a casting region vertically defined by parallel areas of upper and lower cooled endless, flexible traveling casting belts which are supported and revolved by respective upper and lower belt carriages and laterally defined by first and second cooled endless, flexible traveling side dams. The improvement comprises sensing or monitoring the mold contact pressure, for example the contact pressure between the upper belt with its carriage as the upper belt contacts on the surface of the solidifying metal. The vertical displacement between the upper and lower carriages is sensed at a plurality of locations adjacent the casting region. These vertical displacements are arranged to be very small indeed, such as fractions of one thousandth of an inch, or slightly more, and the information obtained by sensing these very small displacements reveals the mold contact pressures occurring and enables the operating parameters of the twin-belt machine to be changed or controlled to achieve the desired range of mold contact pressures and distribution.

The very small vertical displacements so measured also provide the operator with valuable information about the dynamics of the casting operation occuring in the twin-belt casting machine, for example during start-up of the continuous casting operation and during increase in the machine speed and during a continuous casting operation.

The lateral forces which are exerted by the solidifying metal on the first and second side dams are sensed at a plurality of horizontally separated locations along the upstream/downstream length of the casting region. These lateral forces as they are sensed or monitored are also advantageously utilized to determine the mold contact pressure occurring between the solidifying metal and the travelling edge dams, and this information enables the operating parameters of the machine to be changed or controlled to achieve the desired range of mold contact pressures on the sides of the product being cast. The very small lateral displacements which are involved in sensing these lateral forces also provide the operator with valuable information about the dynamics of the casting operation as the continuous casting starts up, as it proceeds and during speed changes.

DESCRIPTION OF THE PREFERRED EMBODIMENTS

Figure 1:
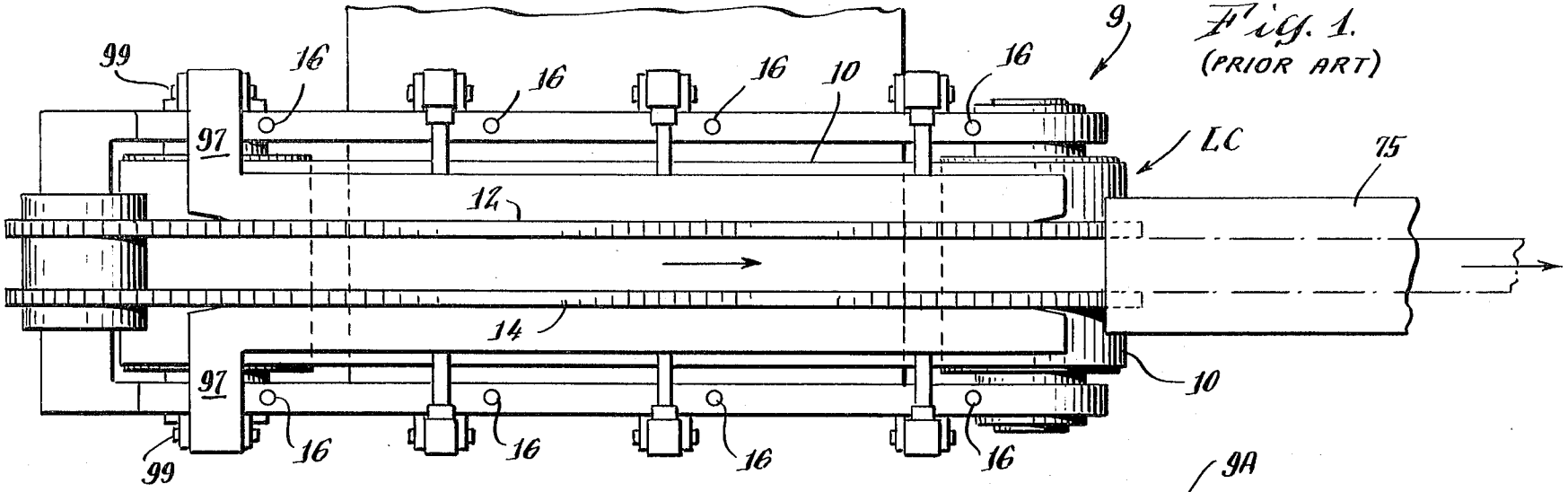
Fig. 1. (PRIOR ART)
FIG. 1 is a plan view of the lower carriage, casting belt and travelling side dam assembly of a continuous casting machine in accordance with the prior art.

Conventionally in continuous twin-belt casting machines, as will be apparent from the referenced prior art patents, the lower carriage and upper carriage are mounted upon a common framework, the upper carriage being movably mounted thereon so that it may be raised and lowered relative to the lower carriage. FIG. 1 illustrates the lower carriage LC of a prior art machine 9 including an endless, flexible, thin, steel casting belt 10 which forms a lower casting surface. In other words, this lower casting belt 10 defines a lower travelling mold surface, while the two travelling side surfaces of the mold are defined by a pair of laterally spaced, parallel, moving side dams 12, 14. A plurality of rigid spacer blocks 16 in this prior art machine are carried by the lower carriage LC and serve to support the upper carriage when it is lowered into position, thereby forming a casting volume in a travelling mold defined by the upper and lower belts and the two side dams, with the upper casting belt defining the upper travelling mold surface. In this manner, there is formed a relatively rigidly controlled casting volume in a prior art machine which, as has been pointed out above, has the disadvantage of not always remaining in close physical contact, or within the desired range of mold contact pressure, with all portions of the surface of the cast product as it cools and shrinks, thus, among other results not always providing the desired localized heat transfer at the respective surface areas of the cast product.

Figure 2:
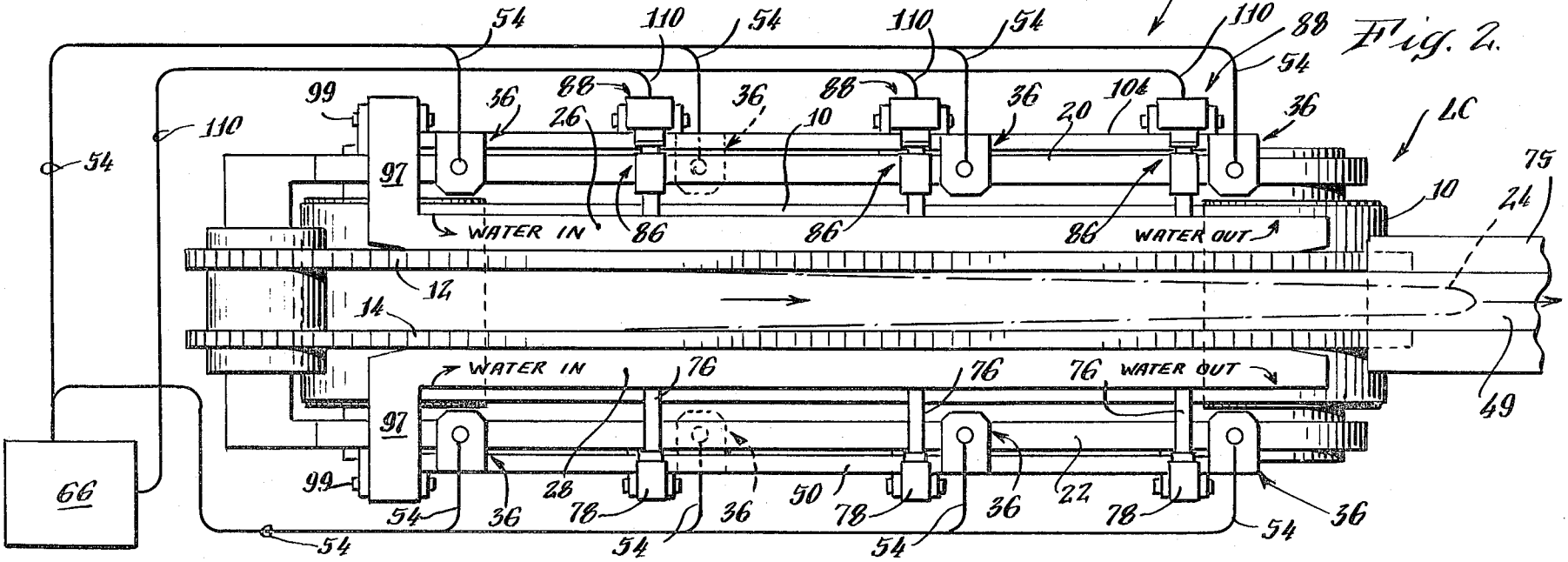
FIG. 2 is a view similar to that of FIG. 1 illustrating the lower carriage and belt assembly of a machine constructed in accordance with the present invention.

The manner in which the disadvantages of the prior art construction of FIG. 1 are overcome are illustrated in FIGS. 2-8. FIG. 2 illustrates the lower carriage LC of a twin-belt machine 9A incorporating the invention. Twin-belt casting types of machines are capable of casting wide strips or slabs or bars, as indicated in the introduction. In this particular embodiment, this twin-belt caster 9A is arranged for casting a bar product having a rectangular cross-sectional area measuring 60 millimeters by 120 mm (approximately 2.36 inches by 4.72 in.) for example such as copper bar or aluminum bar intended to be fed into a rolling mill for being rolled into continuous rod. Thus, this illustrative cast bar is twice as wide as its height.

This machine 9A includes side frames 20, 22 for the lower carriage LC and the lower casting belt 10 is conventionally supported along its lower surface by a plurality of back-up rollers 11 (FIGS. 5, 6) having fins, thereby permitting water cooling of the lower surface of the lower casting belt 10 and also permitting water cooling of the upper surface of the upper casting belt 15. In addition to the fins in the back-up rollers 11, there are collars 18 (FIGS. 5 and 6) on these rollers which engage and support the respective casting belts 10 and 15 in regions near their edges where the side dams 12 and 14 are located and also where the seals are located, as will be explained later.

Figure 5:
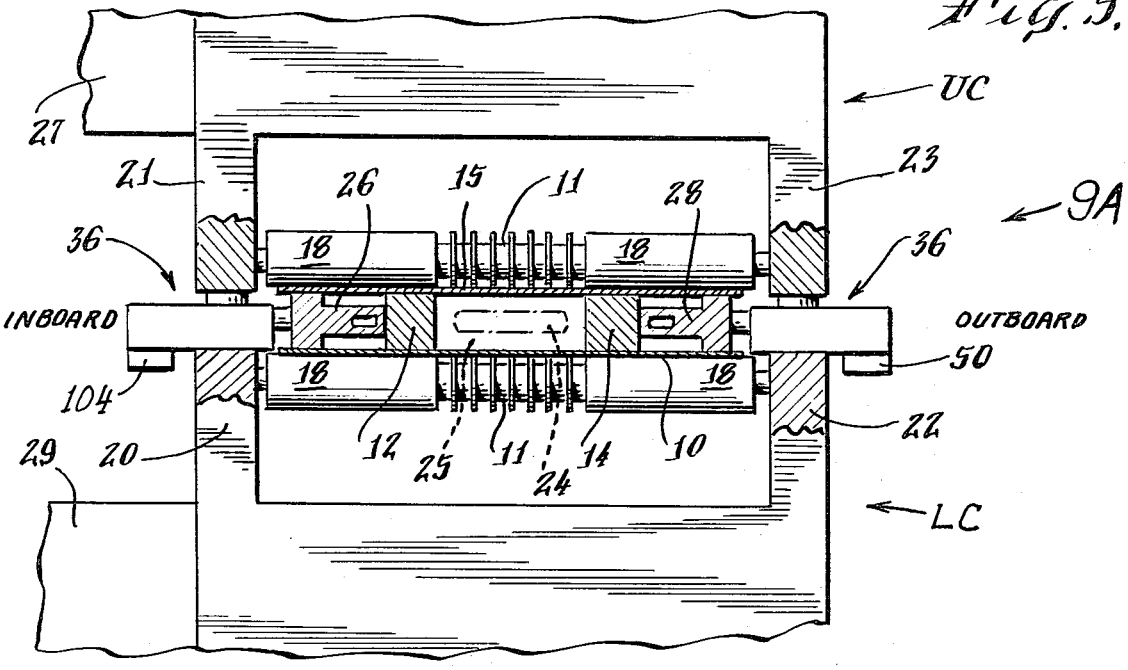
FIG. 5 is a cross-section of a portion of the machine of this invention as seen taken along the plane 5—5 in FIG. 3.
Figure 6:
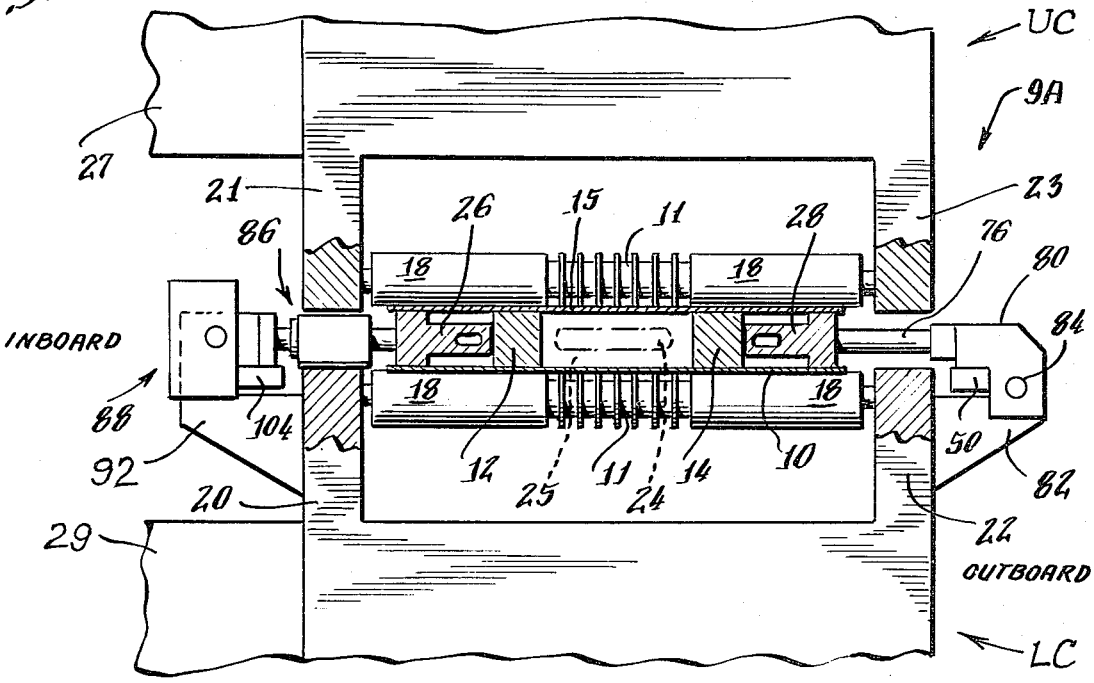
FIG. 6 is a cross-section substantially similar to FIG. 5 but taken along a plane displaced from that of FIG. 5, namely, along the plane 6—6 in FIG. 3.

Travelling upon the upper surface of the lower belt 10 are the side dams 12, 14 which are identical to those illustrated in FIG. 1, but which are not parallel, but converge slightly from left to right, i.e., in the direction of travel of the cast strip, called the downstream direction. The amount of convergence is intended to be equal to the transverse shrinkage of the strip. There is also illustrated in FIGS. 2, 5 and 6 a dashed-dotted line 24 which defines the molten core of the cast product as it progresses through the machine and the solidified shell 25 of this cast product. The travelling side dams 12 and 14 are maintained in the proper alignment by means of respective straight, rigid edge guides 26, 28. The construction of these rigid edge guides will be more apparent from FIG. 7 which discloses the metal edge guides 26 and 28 each having a covering or coating 30 of woven non-flammable asbestos, or of asbestos-substitute material capable of withstanding high temperatures similar to asbestos, and each including an internal longitudinal cooling water passage 32. Conventional sealing members 34 and 35 each with a non-flammable covering 30 prevent entry of water into the mold region. The back-up rollers are omitted from FIG. 7 for clarity of illustration.

As previously explained, a twin-belt casting machine 9 as employed in the prior art had a casting mold volume of generally fixed cross-sectional area, from which casting mold contact pressure could unduly decrease, and even separation of the cast product from the mold surface could result. In accordance with the present invention, however, the contact pressures and distribution of contact pressures of the upper casting belt against the cast metal shell 25 are sensed or monitored by causing the upper carriage to be displaceable vertically, i.e., to be able to "float" vertically, over a very, very small range of the order of fractions of a thousandth of an inch, or slightly more, and then to accurately measure the resultant displacements as caused by the forces exerted on the upper casting belt by the solidifying shell 25 of the molten metal being continuously cast, to the end that uniform and desired predetermined ranges of mold contact pressures and forces are applied to the upper and lower surfaces of the cast product, and desired pressure distributions are obtained.

This sensing of mold contact pressures and forces is accomplished by replacing the spacer blocks 16 of the prior art machines with a plurality of transducers each having an extremely high effective spring constant so that these transducers are very stiff, and thus their total range of travel is 0.003 of an inch or less. These transducers thus effectively serve to "float" the upper carriage relative to the lower carriage, which is considered as being a rigid frame of reference. These transducers then sense the minute displacements (very small changes in distance) between the upper and lower carriage. The upper carriage may then be suitably controlled and/or other changes in the operating parameters may be made and thereby the mold contact pressures and the desired distribution of these mold contact pressures can be maintained, or they can be resumed, if there has been any deviation away from the desired values.

In view of the extreme weights and forces involved with respect to the upper carriage in the continuous casting machine 9A, these transducers may advantageously be load cells of the strain gauge type having a very limited dynamic range such as, for example, 0–0.002 inch between 0–5,000 pounds. Load cells of this type are available commercially from Baldwin Lima-Hamilton under the designation C2M1-S.

As seen in FIGS. 5 and 6, the upper carriage UC includes side frame members 21 and 23 which are aligned with and located directly above the respective side frame members 20 and 22 of the lower carriage LC, when the upper carriage is in its operating position as seen in these FIGURES. Also, as seen in FIGS. 5 and 6, the left side of the upper and lower carriages is called the "inboard side," because this is the side from which these carriages are held in cantilevered relationship by the main support members 27 and 29, while the right side is called the "outboard side," as indicated by the legends. The upper main support member 27 is arranged for lifting and lowering the upper carriage UC, as will be understood from U.S. Pat. Nos. 3,142,873 and 3,848,658 of R. W. Hazelett et al.

Figures 3, 4:
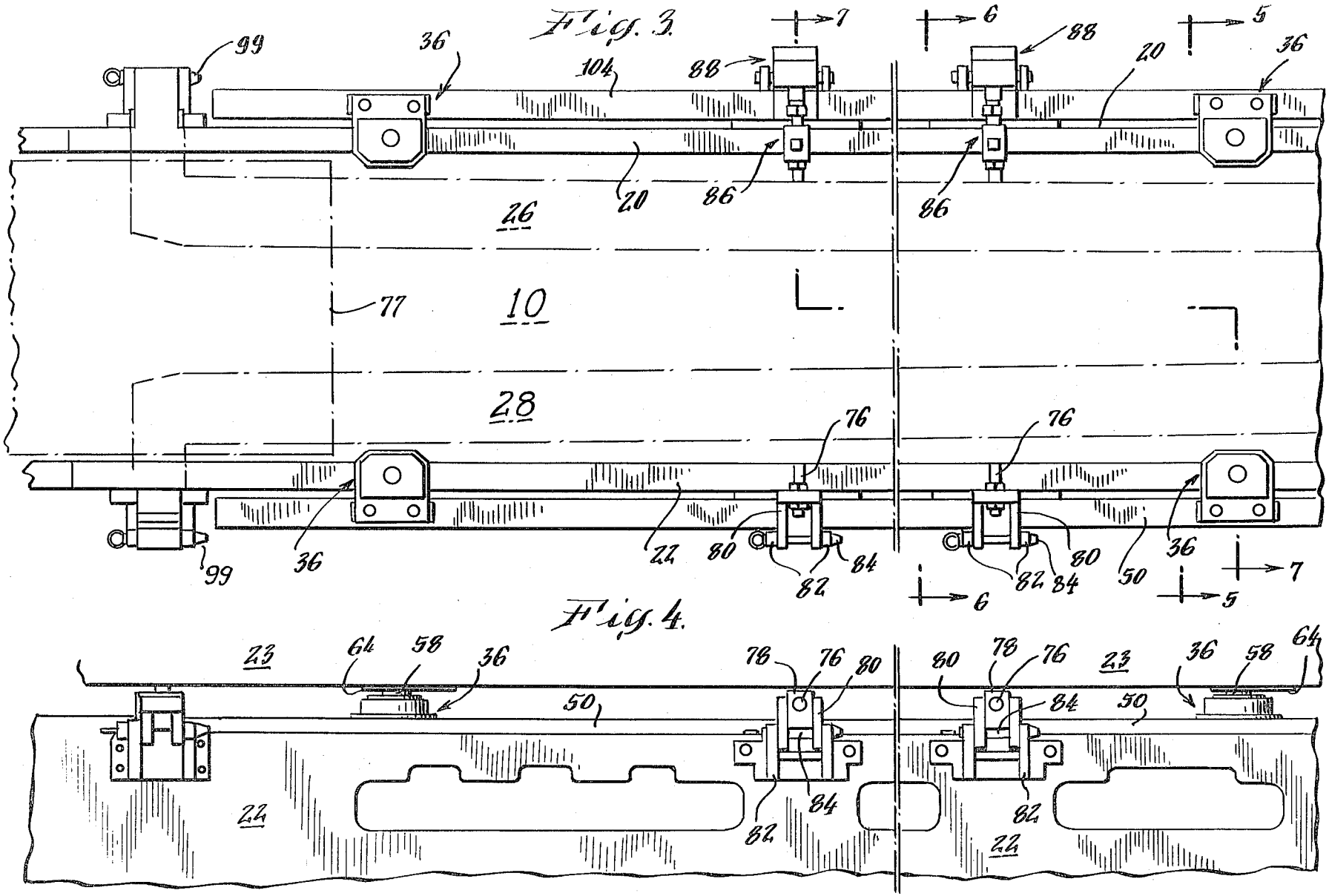
FIG. 3 is an enlarged illustration of a portion of FIG. 2 illustrating the invention in more detail.
FIG. 4 is a side elevational view of the machine of FIG. 3 along a portion of length of the casting region.

FIGS. 2, 3 and 4 illustrate in more detail the placement of load cell assemblies 36 between the frames 20 and 22 of the lower carriage and the respective frames 21 and 23 of the upper carriage. These load cell assemblies 36 are shown as being uniformly spaced, for example, at four locations along the length of the lower carriage, for example near the input end of the casting mold, near the output end of the casting mold, and at the one-third point and at the two-thirds point along the length of the casting mold. The dotted line showing one of these load cell assemblies 36 is merely to indicate that a full complement may not be required; in other words, the load cell assemblies on each side at the one-third point may be omitted as shown dotted. Since these assemblies 36 are substantially identical, they are given similar reference numerals.

Figure 7:
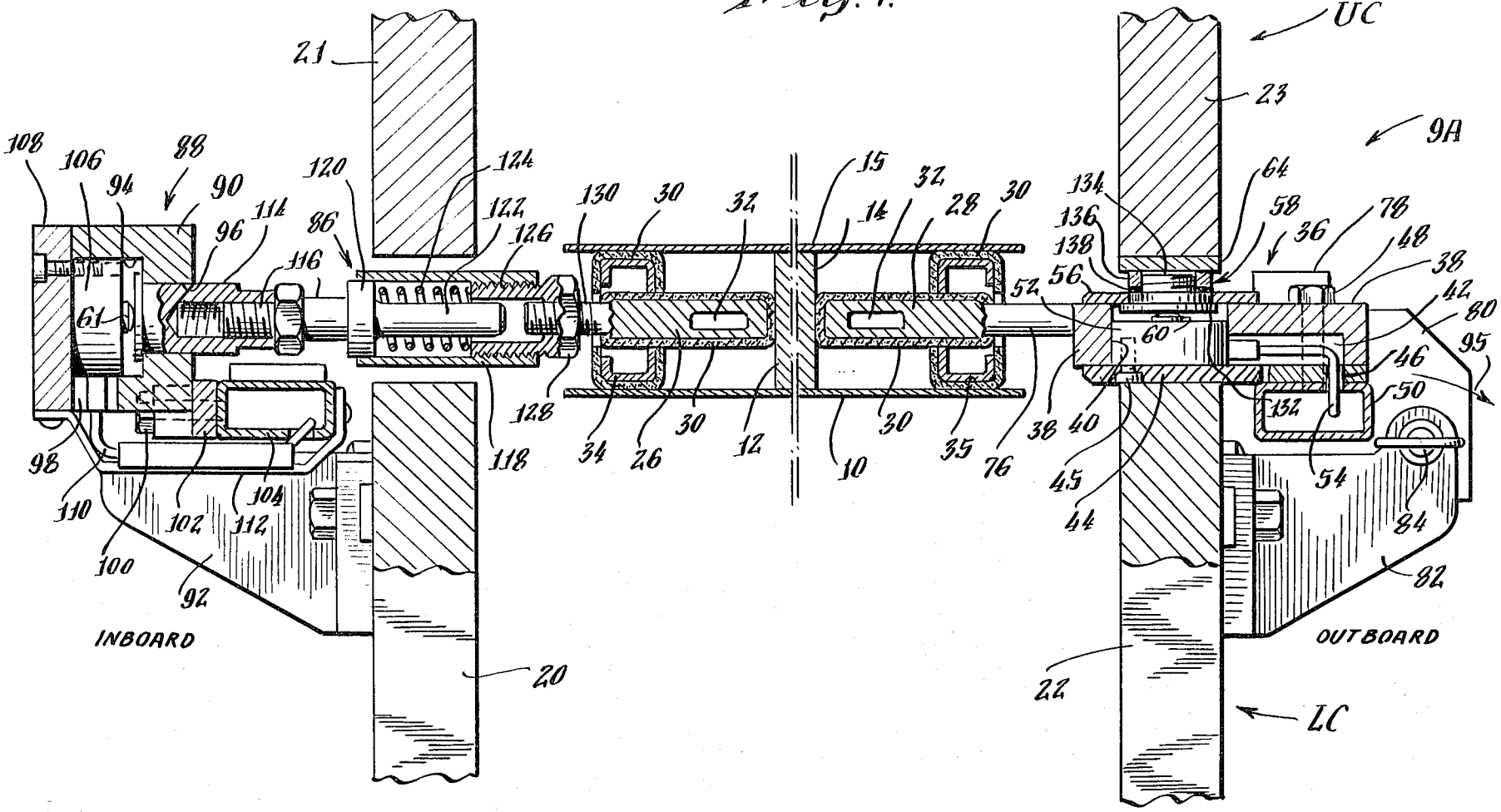
FIG. 7 is a cross-section taken substantially along the broken line 7—7 in FIG. 3, portions of FIG. 7 being broken away to illustrate the internal construction.

One of such load cell assemblies 36 is illustrated in enlarged cross-sectional detail in FIG. 7. It comprises a substantially rectangular housing 38 defining a vertical, cylindrical well 40 therethrough communicating with a wiring chamber 42. The bottom of this rectangular housing 38 is closed by a cap plate member 44 which defines a wire passage 46 therethrough. The outer end of the housing 38 and the outer end of the cap plate 44 which extend outboard beyond the side frames 22 and 23 are secured by means of a pair of screws 48 to a rectangular conduit 50. The inner end of this cap plate member 44 is removably secured to the housing 38 by suitable fastening means, such as machine screws 45.

Mounted within the well 40 is a load cell 52 having output leads in an electrical cable 54 which extends out through the wiring chamber 42 and down through the passage 46 into the conduit 50. Around the top of the well 40 is a cover 56 which has a central opening for receiving a movable thrust button 58 which rests upon the actuating head 60 of the load cell 52. Positioned above the load cell assembly 36 is the side frame 23 of the upper carriage UC which carries a wear plate 64 for engaging down upon the thrust button 58.

Figure 8:
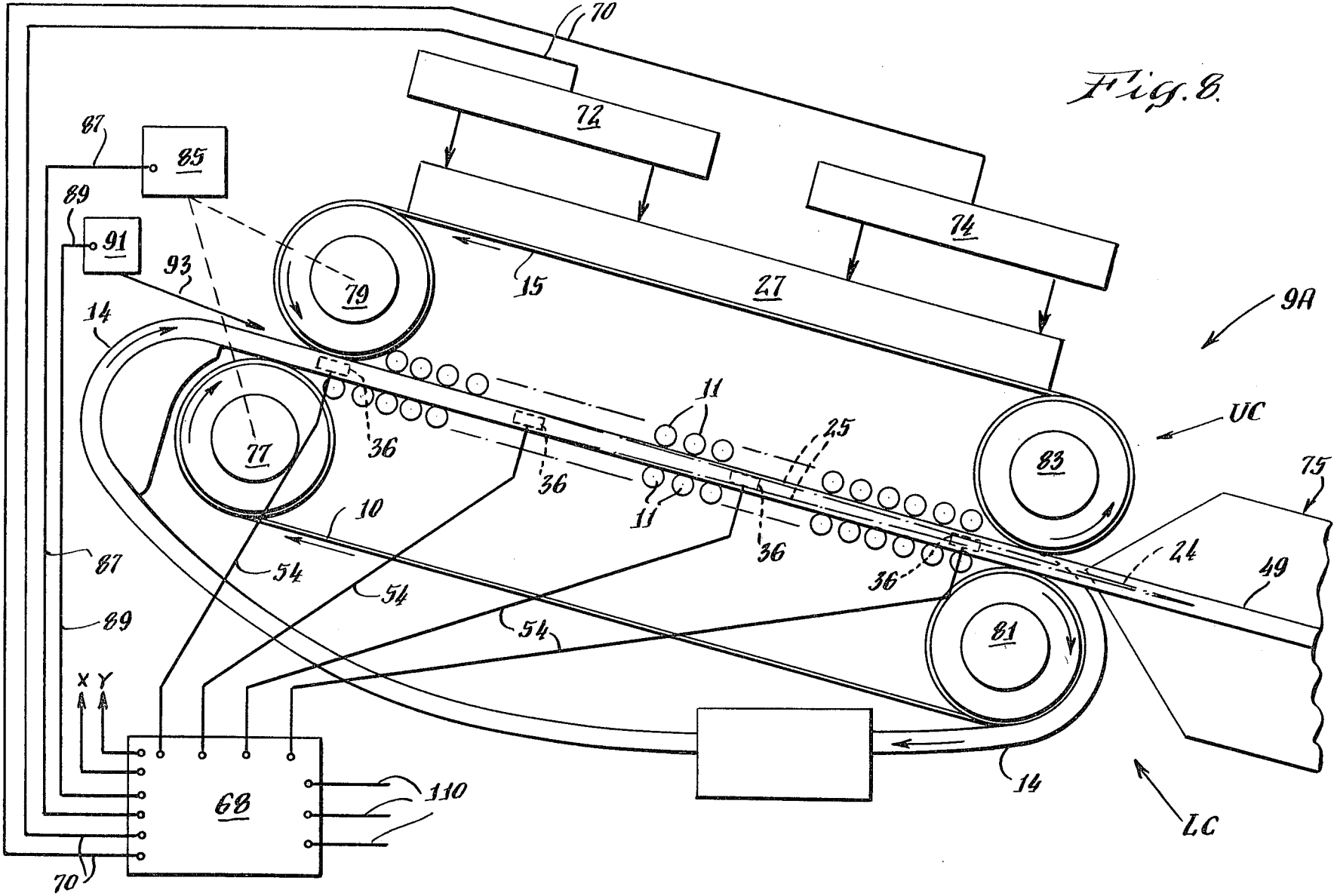
FIG. 8 is a schematic diagram illustrating ways in which this invention may be utilized for automatic control of casting parameters affecting mold contact pressure and pressure distribution.

As seen in FIG. 7, the bottom of the load cell 52 is resting upon the cap plate member 44 which in turn rests directly on the top of the side frame member 22 of the lower carriage LC. This frame 22 of the lower carriage and the frame 20 on the inboard side arm both held fixed rigidly in position, thereby serving as references for sensing displacement of the side frames 23 and 21, respectively, of the upper carriage relative to the lower carriage. The full weight of the upper carriage is usually allowed to rest down upon the load cell assemblies 36 as indicated in FIG. 8. As diagrammatically indicated in FIG. 8, there are hydraulic lift cylinders 72 and 74 which are connected to the support frame 27 of the upper carriage. The lift cylinder 72 is located relatively near the input (or upstream) end of the upper carriage, while the other lift cylinder 74 is located relatively near the output (or downstream) end. The "dead weight" of the upper carriage is, for example approximately 14,000 lbs.

If these hydraulic cylinders 72 and 74 are not pressurized, then this dead weight of 14,000 pounds rests down on the six (or eight) load cells 52, depending upon whether the ones at the one-third point are omitted (or not) as discussed earlier. A minor amount of this dead weight is carried by the longitudinally extending sealing members 34 and 35 (FIG. 7) which are intentionally made to be relatively springy and yielding in a vertical direction for resiliently firmly pressing their non-flammable heat resistant covering 30 against the upper and lower belts in sliding water-sealing relationship. For example, these two springy sealing members 34 and 35, which extend for the full length of the casting mold, may cumulatively resiliently carry a total of approximately 3,000 lbs. of the upper carriage dead weight of 14,000 lbs., leaving a balance of approximately 11,000 lbs. to be carried by the six or eight load cells 52.

In most continuous casting operations it is our preference that the hydraulic cylinders 72 and 74 be sufficiently pressurized with hydraulic fluid for exerting a down thrust of approximately 4,000 lbs on the upper carriage, so that the total load being carried by the six or eight load cells 52 is approximately 15,000 lbs. For example, if there are six load cells 52, then this total load of 15,000 lbs. amounts to a loading of approximately 2,500 pounds per load cell. This value of 2,500 pounds advantageously falls exactly in the center of the range of 0 to 5,000 pounds for the particular load cells as illustratively specified above. Thus, either increases or decreases in mold contact pressures in the vertical direction are readily sensed by these load cells since they are each normally operating near their mid-range point.

It is to be understood that an increase in contact pressure of the cast metal against the upper and lower belts will exert an increased upward force on the upper belt, thereby decreasing the forces on the vertical load cells 52. Thus a decrease in vertical load cell forces indicates an increase in mold contact pressures in the vertical direction. Conversely, a decrease in pressures of solidifying metal against the upper and lower belts will cause increases in forces on the vertical load cells 52. Thus an increase in vertical load cell forces sensed and indicated by load cells 52 tells the operator that a decrease in vertical mold contact pressures is occurring.

In summary, the readings from these vertical load cells vary inversely as a change in vertical mold pressures. Based on his interpretation of load cell reading variations, which may sometimes be relatively small, the operator may slightly correct the mold parameters in order to restore the desired mold contact pressures.

In FIGS. 2 and 8 the electrical cables 54 from the various load cell assemblies 36 are drawn for clarity of illustration leading away from the casting machine 9A. Actually these cables 54 all extend longitudinally within the conduits 50 where they are protected, or will be understood from FIG. 7, to a common outlet post from which these cables 54 run to a control console 66 (FIG. 2) or to a control console 68 (FIG. 8), as the case may be.

The signals from the respective load cell assemblies 36 on each side of the machine 9A are supplied via their respective output lead cables 54 to a suitable digital display and control console unit 66, as illustrated in FIG. 2, where these signals may be recorded and/or viewed by an operator and utilized to adjust the upper carriage and/or other operating parameters so as to maintain or to readjust the desired mold contact pressures and the distribution of mold contact pressure being exerted against the solidifying shell 25 of the cast product 49.

In operation, for example, if the digital read outs on the console 66 show that contact pressure between the solidifying shell 25 and the upper casting belt 15 is changing below or above the desired pressure level at the downstream end of the casting machine, then the operator may increase or decrease the downstream mold taper by progressive accurate and minute changes in vertical load cell assembly thickness, in order to restore the desired mold contact pressures. Tiny increases in mold taper serve to increase metal-to-belt contact pressures near the mold downstream end, and vice versa.

Another parameter which can be changed to affect mold contact pressures is casting speed.

Surprisingly, increasing the speed of the casting machine 9A will also increase the mold contact pressure, because a faster casting speed causes a thinner solidified shell 25 to be formed in the caster. In other words, the molten core 24 now runs further downstream so that the cast bar product 49 has a molten core extending downstream well beyond the output end of the casting machine. This cast product 49 enters a secondary cooler 75 (FIG. 8) where it is completely solidified by cooling sprays. The caster is inclined downstream, and molten metal is relatively heavy, hereby exerting a relatively large metalostatic pressure in the molten core 24 due to gravitation. This metalostatic pressure in the molten core 24 progressively increases down along the inclined travelling mold defined by the casting machine. Consequently, as the caster speed is increased, the resultant thinner cast shell 25 is more readily pressed outwardly by the outward-acting metalostatic pressure of the molten core 24, thereby restoring the desired mold contact pressures near the downstream end of the mold.

The casting belts 10 and 15 are driven by large diameter rolls 77 and 79 (FIG. 8) at the input end of the respective lower and upper carriages, and these belts are tensioned and steered by large diameter rolls 81 and 83 at the output end, as explained in U.S. Pat. Nos. 3,878,883, 3,949,805, and 3,963,068 of R. W. Hazelett et al. In order to drive the rolls 77 and 79 there is an electrical motor energized drive mechanism 85 mechanically connected to the rolls 77 and 79 for rotating them at the same speed as indicated by the dashed lines in FIG. 8. For increasing (or decreasing) the caster speed, the operator increases (or decreases) the speed of the drive mechanism 85.

In order to cause the rate of feed of molten metal into the input end of the caster automatically to match the increase (or decrease) in speed of the caster, there are provided and employed control apparatus and method as shown in U.S. Pat. Nos. 3,864,973 and 3,921,697 in the name of C. J. Petry for sensing the level of the molten metal in the input to the caster and for automatically controlling the rate of feed of the molten metal. Alternatively, the operator can manually adjust the rate of metal feed, but we much prefer to utilize automatic metal feed rate control as shown in these patents. Instead of manually observing the digital read out on the control console 66 (FIG. 2) for the operator to control the operating parameters affecting mold contact pressures, the signals from the respective load cells 52 may be utilized for advantageously providing automatic control as schematically illustrated in FIG. 8, wherein the signals are supplied through the electrical cables 54 to a microprocessor-type control unit 68 which may serve to control or adjust the forces or mold contact pressures being exerted by the upper carriage UC, via control signals transmitted over electrical control lines 70 for controlling, for example, the hydraulic cylinder units 72, 74. The electrical control lines 70 are connected to control valves and pressure regulators for automatically and independently controlling the amount of down thrust exerted by each of the hydraulic lift cylinders 72 and 74.

Usually the mold contact pressures along the upstream end of the casting mold do not require much adjustment, because the solidified shell 25 is relatively thin and does not yet tend to shrink away from the mold surfaces. Mold contact pressures can be increased slightly at the input end of the machine by raising the level of the molten metal at the input, and decreased slightly by lowering this level.

With respect to automatic control, the controller 68 may also be connected by an electrical control cable 87 to the caster drive mechanism 85 for controlling the speed of this machine. The rolling mill (not shown) which may be located downstream from the secondary cooler 75 is automatically controlled by means known in the art for matching to the speed of the caster 9A.

If desired, the controller 68 may also have an electrical cable 89 connected to a molten metal feed rate controller 91, for example such as a movable stopper valve associated with a feed spout leading from a pouring box or launder down into a tundish located at the input end of the caster for controlling the molten metal infeed 93. Alternatively, as described above, the feed rate controller 91 may be automatically regulated by the apparatus and by employing the molten metal level sensing method described in said Petry patents.

The metal feed rate controller 91 may be subject to the control of both the Petry apparatus and of the controller 68. Thus, the Petry apparatus acts as the dominant control for always assuring that the molten metal level does not rise above nor fall below predetermined limits, while the controller 68 controls one or more of the various mold contact pressure affecting parameters 72, 74, 85 and 91.

It is among the advantages of this automatic control as shown in FIG. 8 that the operating parameters of the caster 9A can then serve as the "master" to which the metal infeed rate is matched and to which the speed of the downstream rolling mill (if any) is matched, thereby optimizing the production rate and properties of the cast product 49.

In normal operation the upper casting belt 15 converges only very slightly toward the lower casting belt 10 in order to match with the shrinkage of the cast shell 25 as it thickens and becomes cooled.

The outboard moving side dam 14 is restrained from lateral movement by conventional means shown in FIGS. 2–4 including the rigid straight guide 28 held by horizontal rods 76, each extending from a mounting block 78 secured in a clevis 80. Each clevis 80, in turn, is pivotally mounted to a mounting bracket 82 by means of a removable pin 84. This pivot pin 84 is removable to facilitate the replacement of components and for maintenance procedures and has a ring at one end for convenience in extracting it.

By virtue of the fact that the clevis 80 can be swung around the pivot pin 84 (Please see FIG. 7) the whole side dam guide assembly including the guide 28, seal member 35, holding rods 76, blocks 78, and clevises 80 can be swung outboard and down, as shown by the arrow 95, for moving this whole assembly quickly and easily down out of the way for changing of side dams and casting belts. This ability to swing the side dam guide and assembly outboard and down out of the way was also provided in the prior art machine FIG. 1. The side dam guide 28 is L-shaped and has a lateral arm 97 at its upstream end held by a pivot pin 99 aligned with the pivot pins 84.

The inboard side dam 12 is also laterally restrained by the equivalent of a plurality of rods holding the rigid, straight guide 26. Each of these holding rods, however, comprises a spring relief assembly 86 connected at one end to the edge guide 26 and at the other end to a load cell assembly 88. As illustrated in more detail in FIG. 7, the load cell assembly 88 includes a substantially cup-shaped housing 90 supported against the side frame 20 by means of a mounting bracket 92. The housing 90 defines a horizontal cylindrical well 94, a horizontal bore 96 extending through the inner wall of the housing 90 into communication with the well 94, and a vertical wiring passage 98. Secured to each of the load cell assemblies 88 by means of bolts 100 and spacers 102 is a conduit 104 which is similar to conduit 50 on the outboard side of the machine.

A lateral load cell 106, which is similar to the vertical load cell 52, except that it has a different range as will be explained later, is mounted within the well 94, and the housing 90 is closed by a cap 108. The leads 110 from load cell 106 pass through the wiring passage 98 and into the conduit 104. They are protected by means of a shielding strap 112 which is secured between the cap 108 and the conduit 104. Slidably mounted within the bore 96 of the housing 90 is a thrust button 114. This thrust button 114 engages the actuating head 61 of the load cell 106 and, at its other end, is bored and internally threaded to receive a threaded shaft 116 which forms a portion of the spring relief assembly 86.

The spring relief assembly 86 includes a tubular housing 118 having its right end internally threaded. This housing 118 slidably receives in its left end an enlarged annular shoulder 120 of the shaft 116 which also includes a smaller diameter shank portion 122 which extends axially inwardly of the housing 118. Positioned around the shank 122 is a compression coil spring 124. At its left end the spring 124 is in engagement with the shoulder 120. It is compressed at its right end by the end of a sleeve 126 which is threaded and screws into the end of the housing 118 for adjustment of the spring force. The degree of insertion of sleeve 126 and thus the initial set value of the compression of the spring 124 is controlled by means of a nut 128 which is secured to the sleeve 126 for screwing this sleeve into or out of the tubular housing 118, and this nut 128 threadedly engages a stud 130 connected to the edge guide 26.

During normal operation, the spring relief assembly 86 functions as a rigid rod extending between the edge guide 26 and the load cell 106. The signals from the respective load cells are transmitted through their leads 110 to the control console unit 66, as shown in FIG. 2. (It will be understood that this is a schematic illustration inasmuch as the actual leads pass through the conduit 104). As pressures on the side dams increase and decrease, their positions may be readily adjusted by an operator or through a feedback control system of the type previously discussed in connection with the vertical force load cells. The function of the spring relief assembly 86 is to act as a mechanical "fuse." In other words, they are adjusted such that when a selected load is exceeded, the spring 124 will yield thereby to provide lateral relief for preventing the buildup of machine-damaging forces.

The lateral positioning of the edge guides 26 and 28 relative to each other is adjusted by screwing the threaded rod 116 into or out of the thrust button 114. As can be seen by a close examination of FIGS. 2 and 3, the edge guides 26 and 28 are initially set so that they converge slightly, by a few thousands of an inch, in a downstream direction. Thus, the travelling edge dams 12 and 14 are caused to converge downstream by a slight amount during normal operation of the machine 9A. Since the cast product 49 has a height which is relatively great, being one-half of the product width in this example, it is important that the side dams 12 and 14 be pressed firmly against the side surfaces of the solidifying shell 25 for providing adequate cooling of these side surfaces to prevent hot spots and uneven solidifying rates which would adversely affect the properties of the freshly cast metal.

The cooling water passages 32 extending longitudinally in the straight edge guides 26 and 28 are novel. These cooling passages prevent thermal distortion of the edge guides, thereby maintaining these guides straight and true for accurately guiding the side dams 12, 14 for accurately sensing and monitoring lateral mold contact pressures at the various load cell assemblies 88.

In order to provide automatic control of the mold side contact pressures, the spring relief units 86 are replaced by hydraulic cylinders and pistons (not shown). The forces exerted by such hydraulic cylinders and pistons are then controlled through the leads X, Y (FIG. 8) by the microprocessor controller 68. Also, the cables 110 from the lateral pressure sensing load cell assemblies 88 are then connected into the controller 68 as shown in FIG. 8.

It will be understood that FIG. 8 schematically illustrates that all of the vertical load cell assemblies 36 on both sides of the machine have their cables 54 connected to the controller 68.

In order to adjust the downstream convergence of the upper casting belt 15 with respect to the lower casting belt 10, the vertical dimension of each thrust button 58 (FIG. 7) is adjustable. This thrust button includes a shoulder screw having a lower flange 132 located below the cover 56 for preventing the thrust button from inadvertently becoming removed from the assembly 36. Extending up from this flange 132 is the short threaded shank 134 of the shoulder screw, and a nut 136 on this shank engages the wear plate 64. There is a removable shim 138 between the nut 136 and the shoulder of this shoulder screw. By using shims of different predetermined thicknesses the elevation of the nut 136 is adjusted for effectively changing the overall height of the thrust button 58. The wear plate 64 (FIG. 3) is elongated in the upstream/downstream direction, because the longitudinal position of the upper carriage can be adjusted relative to the lower carriage, as will be understood from U.S. Pat. No. 3,848,658 of R. W. Hazelett et al.

The most informative mold contact pressure sensing assemblies are those located at or near the downstream end of the caster where the solidifying shell 25 is thickest. For example, in certain cases, when the most accurate control of the caster is not needed, then all of the load cell assemblies 36 and 88 can be replaced by fixed members, except for the most downstream pair of vertical sensors 36 and the most downstream lateral sensor 88.

Although the two upper carriage lift and downthrust means 72 and 74 are described as being hydraulic cylinders with pistons, they can be other controllable mechanical elevating and lowering arrangements, for example such as two controllable-motor-driven screw jack assemblies.

The load cells 106 for sensing lateral forces are load cell model No. 3630-101 obtainable from Lebow Associates, Incorporated of Troy, Mich., and having an operating range of 0–1,000 lbs. with a deflection of 0–0.003 of an inch over said operating range.

It is to be understood that the readings of the lateral load cells are direct readings. In other words, an increased lateral force reading from a lateral load cell 106 indicates an increased lateral pressure of the cast metal against the side surfaces of the casting mold in the region near that particular load cell. Conversely, a decreased lateral force reading from a lateral load cell indicates a decreased lateral pressure of the cast metal against the side surfaces of the casting mold in the region near that particular load cell.

It is believed that the many advantages of this invention will now be apparent to those skilled in the art. It will also be apparent that a number of variations and modifications of this invention may be made without departing from its spirit and scope. Accordingly, the foregoing description is to be construed as illustrative only, rather than limiting. This invention is limited only by the scope of the following claims.

We claim:

1. In the method of continuously casting metal product directly from molten metal in which the molten metal is confined and solidified in a casting region vertically defined by parallel areas of upper and lower cooled, endless, flexible travelling casting belts supported in respective upper and lower belt carriages and laterally defined by first and second cooled endless, flexible travelling side dams, the invention which comprises:

establishing a plurality of monitoring locations along the confines of said casting region;

measuring, at each of said monitoring locations, the force serving to confine the solidifying metal within said casting region by sensing the force exerted by said metal through either carriage by measuring the relative displacements, occurring between the upper and lower carriages; and utilizing the resulting information for improving the casting operation.

2. The method of continuously casting molten metal of claim 1, wherein the sensed forces are related to the vertical dimensions of said casting region.

3. In the method of continuously casting metal product directly from molten metal in which the molten metal is confined and solidified in a casting region vertically defined by parallel areas of upper and lower cooled, endless, flexible travelling casting belts supported in respective upper and lower belt carriages and laterally defined by first and second cooled endless, flexible tavelling side dams, the invention which comprises:

establishing a plurality of monitoring locations along at least one of the side dams;

measuring, at each of said monitoring locations, the force serving to confine the solidifying metal within said casting region by measuring the lateral force on the respective side dam and utilizing the resulting information for improving the casting operation.

4. The method of continuously casting molten metal of claim 2, wherein the sensed forces are related to vertical dimensions of said casting region near the downstream end of said region.

5. The method of continuously casting molten metal of claim 3, wherein said portion of the measured forces are those exerted laterally on said side dams near the downstream end of said region.

6. The method of continuously casting molten metal of claim 1, 2, or 4, wherein the dead weight of the upper carriage acting downwardly is augmented by mechanical down thrusts applied to the upper carriage at two locations, said two down-thrust locations being near the upstream and downstream ends of the upper carriage, respectively, including the step of:

utilizing the resulting information for controlling the magnitude of the down thrust being applied to the upper carriage at least one of said locations.

7. The method of continuously casting molten metal of claim 1, 2, 3, 4 or 5, wherein said casting belts are each driven at the same speed, and said speed is controllable for increasing or decreasing the linear speed of travel of the casting belts and side dams along the casting region, including the step of:

utilizing the resulting information for controlling the linear speed of travel of the casting belts.

8. The method of continuously casting molten metal of claim 4 or 5, wherein said casting belts are each driven at the same speed, and said speed is controllable for increasing or decreasing the linear speed of travel of the casting belts and side dams along the casting region, including the steps of:

increasing the linear speed of travel of the casting belts and side dams along the casting region when such a sensed force near the downstream end of the casting region has decreased from a predetermined value; and decreasing said linear speed when such a sensed force has increased from a predetermined value.

9. In the method of continuously casting metal product directly from molten metal in which the molten metal is confined and solidified in a travelling casting region vertically defined by parallel areas of upper and lower cooled, endless, flexible travelling casting belts supported in respective upper and lower belt carriages and laterally defined by first and second cooled endless flexible travelling side dams, and wherein each of said carriages has first and second rigid side frame members, the side frame members of the upper carriage being aligned with the respective first and second side frame members of the lower carriage, the invention which comprises the steps of:

holding the first and second frame members of the lower carriage fixed in position;

establishing at least one vertical displacement monitoring location between the first side frame member of the lower carriage and the first side frame member of the upper carriage;

establishing at least one vertical displacement monitoring location between the second side frame member of the lower carriage and the second side frame member of the upper carriage;

sensing, at each of said monitoring locations, the vertical displacement occurring between said respective frames as a result of changes in pressure being exerted by the solidifying metal against the upper travelling casting belt; and changing predetermined parameters of the continuous casting method for maintaining the vertical displacement within predetermined limits.

10. The method as claimed in claim 9, wherein:

one of said monitoring locations is established between the respective first side frame members near the downstream end of the casting region; and another of said monitoring locations is established between the respective second side frame members near the downstream end of the casting region.

11. The method as claimed in claim 9 or 10, including the steps of:

establishing a plurality of said monitoring locations between the respective first side frame members at positions spaced longitudinally along the casting region;

establishing a plurality of said monitoring locations between the second side frame members at positions spaced longitudinally along the casting region; and simultaneously sensing the vertical displacements occurring at each of said monitoring locations during the continuous casting.

12. The method as claimed in claim 10, including the steps of:

increasing the travel speed of the casting belts and side dams when there is a downward vertical displacement of the downstream portions of the first and second side frame members of the upper carriage relative to the respective first and second side frame members of the lower carriage; and decreasing the travel speed of the casting belts and side dams when there is an upward vertical displacement of the downstream portions of the first and second side frame members of the upper carriage relative to the respective first and second side frame members of the lower carriage.

13. The method as claimed in claim 9, 10 or 12, including the step of:

automatically controlling one or more of said parameters as a result of the sensed information.

14. In the method of continuously casting metal product directly from molten metal in which the molten metal is solidified in a casting region vertically defined by parallel areas of upper and lower cooled, endless, flexible travelling casting belts supported in respective upper and lower belt carriages and laterally defined by first and second cooled, endless, flexible travelling side dams, the improvement which comprises:

"floating" said upper belt and its carriage on the surface of the solidifying metal for permissible slight vertical displacement of the upper carriage relative to the lower carriage over a range of a few thousandths of an inch;

sensing the vertical displacements occurring between said upper and lower carriages at a plurality of locations adjacent to said casting region; and controlling at least one parameter of the casting method which affects said vertical displacements for maintaining said vertical displacements within predetermined limits.

15. In the method of continuously casting metal product directly from molten metal, the improvement as claimed in claim 14, including the further step of:

sensing the lateral forces exerted by said solidifying metal on said first and second side dams at a plurality of horizontally displaced locations along said casting region; and controlling at least one parameter of the casting method which affects said lateral forces for maintaining said lateral forces within predetermined limits.

16. Apparatus for the continuous casting of metal product directly from molten metal in which the molten metal is confined and solidified in a casting region vertically defined by parallel areas of first and second endless flexible revolving casting belts, and laterally defined by first and second endless, flexible, travelling side dams, comprising:

upper and lower belt carriages, each including one of said endless casting belts and rollers positioned to guide and drive portions of said belts in spaced, parallel relationship to define a continuous casting region therebetween;

means for adjustably, vertically, positioning said upper carriage relative to said lower carriage during a casting run to selectively control contact forces between metal being cast and said first and second casting belts; and means responsive to the forces exerted by said metal through said carriage at a plurality of locations adjacent said casting region for generating output signals proportional thereto.

17. The apparatus as claimed in claim 16, including:

control means responsive to said output signals for indicating the magnitudes of the respective forces.

18. The apparatus as claimed in claim 16, including:

automatic control means responsive to said output signals for automatically controlling at least one parameter of the casting operation affecting said forces for regulating said forces.

19. The apparatus as claimed in claim 16, 17 or 18, wherein said force responsive means are responsive to very small changes in the distances between said upper and lower carriages.

20. The apparatus as claimed in claim 16, 17 or 18, wherein said force responsive means are load cells.

21. The apparatus as claimed in claim 16, 17 or 18, wherein said force responsive means are responsive to the lateral forces on said side dams.

22. The apparatus as claimed in claim 21, wherein said force responsive means are load cells.

23. The apparatus as claimed in claim 21, wherein said force responsive means includes means for releasing said forces at a preselected upper load limit.

24. The apparatus as claimed in claim 16, 17 or 18, wherein said upper and lower carriages each includes first and second side frames and wherein the first and second side frames of the upper carriage are positioned above and in alignment with the respective first and second side frames of the lower carriage, in which:

said force responsive means are load cells responsive to the very small changes in distances between the upper and lower first side frames and between the upper and lower second side frames.

25. The method of continuously casting molten metal of claim 3 or 5, wherein said side dams are guided for converging slightly in the down stream direction.

* * * * *